United States Patent [19]

Amtsberg et al.

[11] 4,157,121

[45] Jun. 5, 1979

[54] HYDRAULIC POWERED ROCK DRILL

[75] Inventors: Lester A. Amtsberg; Paul J. Bilodeau, both of Utica, N.Y.

[73] Assignee: Chicago Pneumatic Tool Co., New York, N.Y.

[21] Appl. No.: 765,529

[22] Filed: Feb. 4, 1977

[51] Int. Cl.[2] ..... B25D 9/00; F01B 7/18

[52] U.S. Cl. ..... 173/95; 173/105; 173/134; 173/DIG. 4; 91/227; 91/303; 91/321

[58] Field of Search ..... 91/50, 226, 227, 303, 91/321, 325, 341 R, 342; 173/95, 97, 105-107, 128, 132-134, DIG. 4

[56] References Cited

U.S. PATENT DOCUMENTS

| | | | |
|---|---|---|---|
| 3,082,741 | 3/1963 | Huffman | 173/97 X |
| 3,490,549 | 1/1970 | Catterson | 173/105 |
| 3,796,271 | 3/1974 | Amtsberg | 173/102 |
| 3,822,633 | 7/1974 | Ottestad | 173/DIG. 4 |
| 3,822,752 | 7/1974 | Montabert | 173/DIG. 4 |
| 3,866,690 | 2/1975 | Lance et al. | 173/DIG. 4 |
| 3,887,019 | 6/1975 | Reynolds et al. | 173/134 |
| 3,892,279 | 7/1975 | Amtsberg | 173/13 |
| 3,995,700 | 12/1976 | Mayer et al. | 173/DIG. 4 |
| 4,072,198 | 2/1978 | Amtsberg | 173/DIG. 4 |

FOREIGN PATENT DOCUMENTS

| | | | |
|---|---|---|---|
| 1223784 | 9/1966 | Fed. Rep. of Germany | 173/134 |
| 55703 | 8/1968 | Poland | 173/105 |
| 183688 | 12/1966 | U.S.S.R. | 173/105 |

*Primary Examiner*—Lawrence J. Staab

[57] ABSTRACT

A rock drill having a hydraulic pressure reservoir formed by the drill housing, and an anvil rotation mechanism enclosed in the housing. A piston of substantial length and a mechanical hydro-operated valve means, provide favorable pulse duration and low impact velocity. The piston has only two sliding seal diameters which permits simplified valve and cylinder configuration. The friction surfaces of the fronthead drill assembly are lubricated and cooled by integration with the circulating hydraulic system. A floating seal cartridge between the piston and anvil, tends to rotate the piston with the anvil to minimize rotative scrubbing at impact.

9 Claims, 7 Drawing Figures

HYDRAULIC POWERED ROCK DRILL

BACKGROUND OF THE INVENTION

The invention relates to a hydraulically operated rock drill of the percussive type. The rock drill represents an improvement in a well known and crowded art, and features a combination of various means, some known in the art, to provide a rock drill of exceptional operational effectiveness.

Various attempts have been made in the rock drill art to provide what is frequently referred to as "optimum pulse width" with referring to the shape of the stress wave in the drill steel, as displayed on an oscilloscope. Optimum pulse width is three to eight times greater than that produced by a conventional piston hammer striking a conventional drill steel, and it varies with the hardness or stiffness of the rock being drilled. Reference may be had to U.S. Pat. No. 3,796,271, and the patents referred to therein, for a discussion of the problem and suggested solutions thereto. The present invention utilizes a long, heavy piston which has a short stroke and low impact velocity to obtain favorable pulse duration. While the ratio of piston length to drill housing length is in the order of 60%, the piston diameter is substantial, thus providing a heavy piston which minimizes overall tool length.

A further feature of the rock drill of the invention is the use of only two sliding seal diameters-contemporary rock drills often employ three diameters which require superprecision manufacture for proper assemblage- the two-diameter arrangement permitting simplest possible valve and cylinder configuration leading to reduction in manufacturing and maintenance costs. A semi-mechanical cycle valve is employed to provide the unusually short stroke that is required when full cross-section of piston is exposed to hydraulic pressure for power-stroke acceleration.

The rock drill of the invention, while utilizing a reservoir of high pressure oil which also serves as the drill housing, as in U.S. Pat. No. 3,892,279, represents an improvement thereover by use of reservoir oil for lubrication and cooling of front head assembly sliding surfaces, and also by full enclosure of anvil rotation means driven by a rear mounted motor, the latter arrangement being less cumbersome and of reduced costs as compared with front head rotation motor constructions.

Still another feature of the invention relates to a floating seal cartridge which provides rotation of the piston with the anvil, thus minimizing rotative scrubbing at impact of the piston upon the anvil.

Other advantages and features of the rock drill of the invention will become apparent as the description of the invention follows in greater detail.

DESCRIPTION OF PREFERRED EMBODIMENT

Figure 1A:
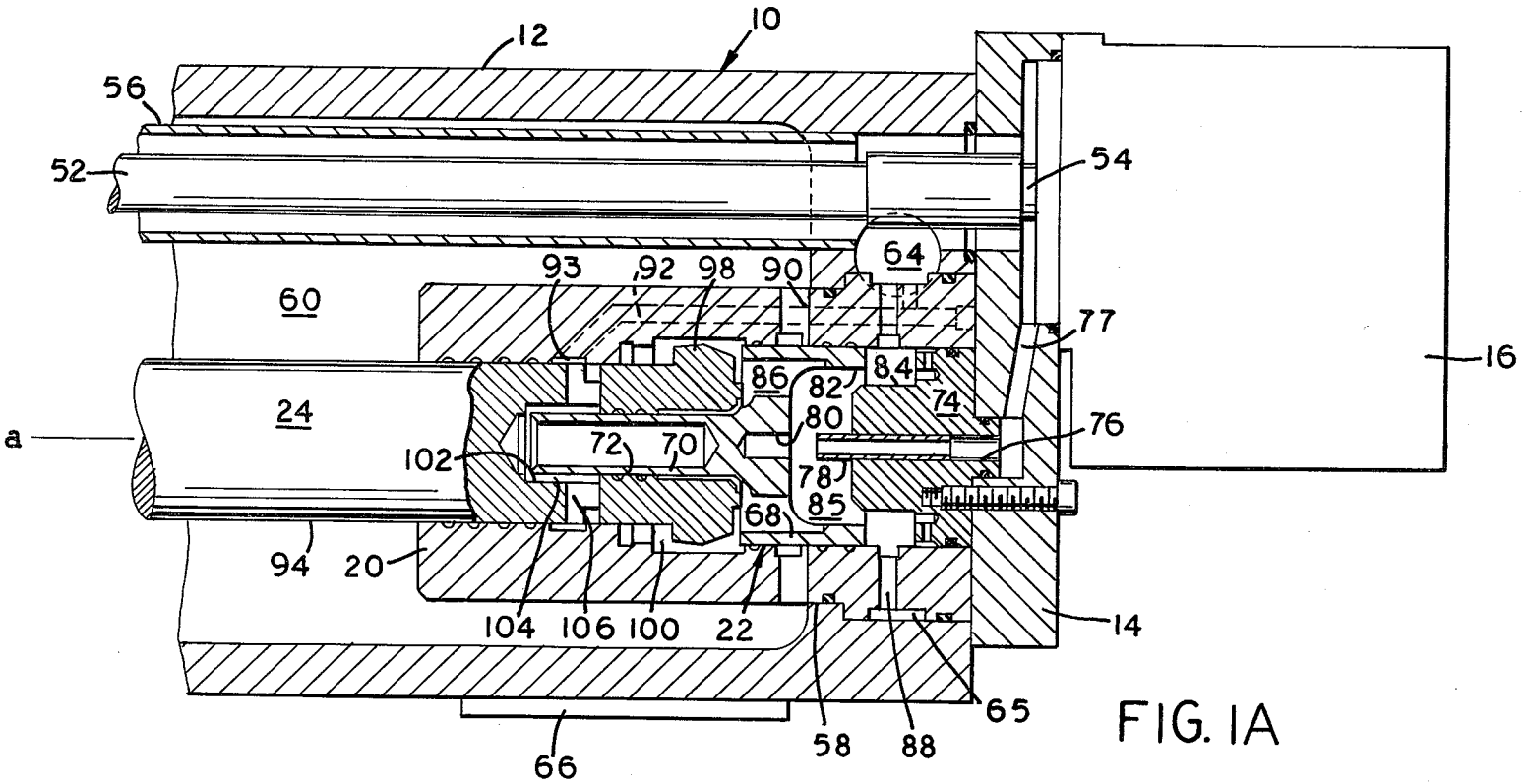
FIG. 1A is a fragmentary sectional view of a rock drill embodying the principles of the invention, and showing a valve end of the drill.

Referring now to the drawings, numeral 10 identifies a rock drill embodying the principles of the invention, which includes a cylindrical housing 12, serving as a bulk oil accumulator or reservoir, a backhead plate 14 which encloses the rear end of the housing and supports a rotation drive motor 16, and a front head 18 enclosing the front end of the housing. Reservoir oil pressure may be in the order of 2000 p.s.i. The drive motor 16 may be hydraulically operated in either direction of rotation and control means (not shown) are provided to effect desired operation. A cylindrical member 20, located at the rear end of the housing 12, functions to enclose a cycle valve 22 and to slidingly support one end of a piston 24, the other end of the piston being supported in a bushing 26 secured in an elongated portion 28 of a bulkhead 30 formed in the housing 12. An axially movable anvil member 32 is located in a gear housing 33 arranged at the front area of the housing 12, the inner end of the anvil being supported in a bushing 34 secured to the bulkhead 30, the other end being supported in a flanged bushing 36 removably affixed to the front head 18 at one side thereof, and a flanged bushing 37 removably affixed to the front head at the other side thereof. The anvil 32 has a threaded portion 38, extending beyond the bushing 36, for receipt of a drill pipe (not shown) forming part of a drill string used in hole drilling operations. Bushing 34 has a counterbore 39 which slidingly receives a hub portion 41 formed on the anvil.

The anvil 32 is provided with a plurality of teeth, or splines 40 which mesh with teeth, or splines 42 formed on the inner circumference of a ring gear 44. The ring gear has teeth 46 formed on the outer circumference which mesh with teeth 47 of a drive gear 48, supported in bearing means 50. The gear 48 is drivingly affixed to a shaft 52 which is connected at the opposite end to an output shaft 54 of the motor 16. A tube 56 surrounds the shaft 52 and seals it from pressure of oil in the interior of the housing 12.

The cylindrical member 20 is supported in the housing 12, a portion of said supporting means comprising a circumferential wall 58 forming one end of an oil reservoir 60, the other end of the reservoir being formed by the bulkhead 30. A passageway means 62 connects the interior of the reservoir 60 with a high pressure oil pump (not shown) for delivery of pressurized oil to the reservoir, while a passageway means 64 connects an annular groove 65 to a sump for oil flow return thereto. Support means 66 may be affixed to the housing 12 for mounting of the rock drill upon a drill carrier (not shown).

The cycle valve 22 comprises a cylindrical valve body 68 and a valve stem 70 which has a sliding fit in an axial bore 72 formed in the end of the piston 24. A plug 74 positioned in the cylindrical member 20, abuts the backhead plate 14, and has an axial bore 76 in which is press fitted a tubular stem 78. The bore 76 leads to a passageway 77 in 68 is formed with a recess 82 having a diameter greater than the diameter of a cylindrical portion 84 to form a cavity 85 between the recess and the cylindrical portion. A plurality of holes 86 are formed in the valve body 68 which provide communication between the recess 82 and the opposite side of the valve body.

The cylindrical member 20 is formed with a plurality of radially arranged holes 88 connecting the cavity 85 with the passageway means 64. Another plurality of radially arranged holes 90, are formed in the cylindrical member 20, forwardly of the holes 88, which connect the reservoir 60 with the interior of the cylindrical member 20. The lateral distance between the holes 88 and 90 is such as to provide substantial cut-off of each when the valve body 68 is in the FIG. 6 position. A passageway 92, formed in the cylindrical member 20, has one end opening unto the body of the piston 24 and the other end into the passageway means 64. A circumferential groove 93 intersects the end of passageway 92.

Piston 24 has a major diameter portion 94, which is slidingly fitted to the cylindrical member 20, and a minor diameter portion 96 which is slidingly fitted to the bushing 26. Reservoir pressure, acting upon the difference in area between diameter portions 94 and 96, provides a relatively small continuous return force on the piston. A tapered head 98 formed at the right extremity of the piston 24, is positioned in an enlarged region of the cylindrical member 20, the space between the tapered head and the enlarged region providing a cavity 100. The piston bore 72 has an enlarged inner end 102 arranged to provide a cavity 104 defined between the exterior of the valve stem 70 and the enlarged inner end. A plurality of radially arranged holes 106 connect the cavity 104 with the exterior of the piston diameter portion 94.

Figure 1B:
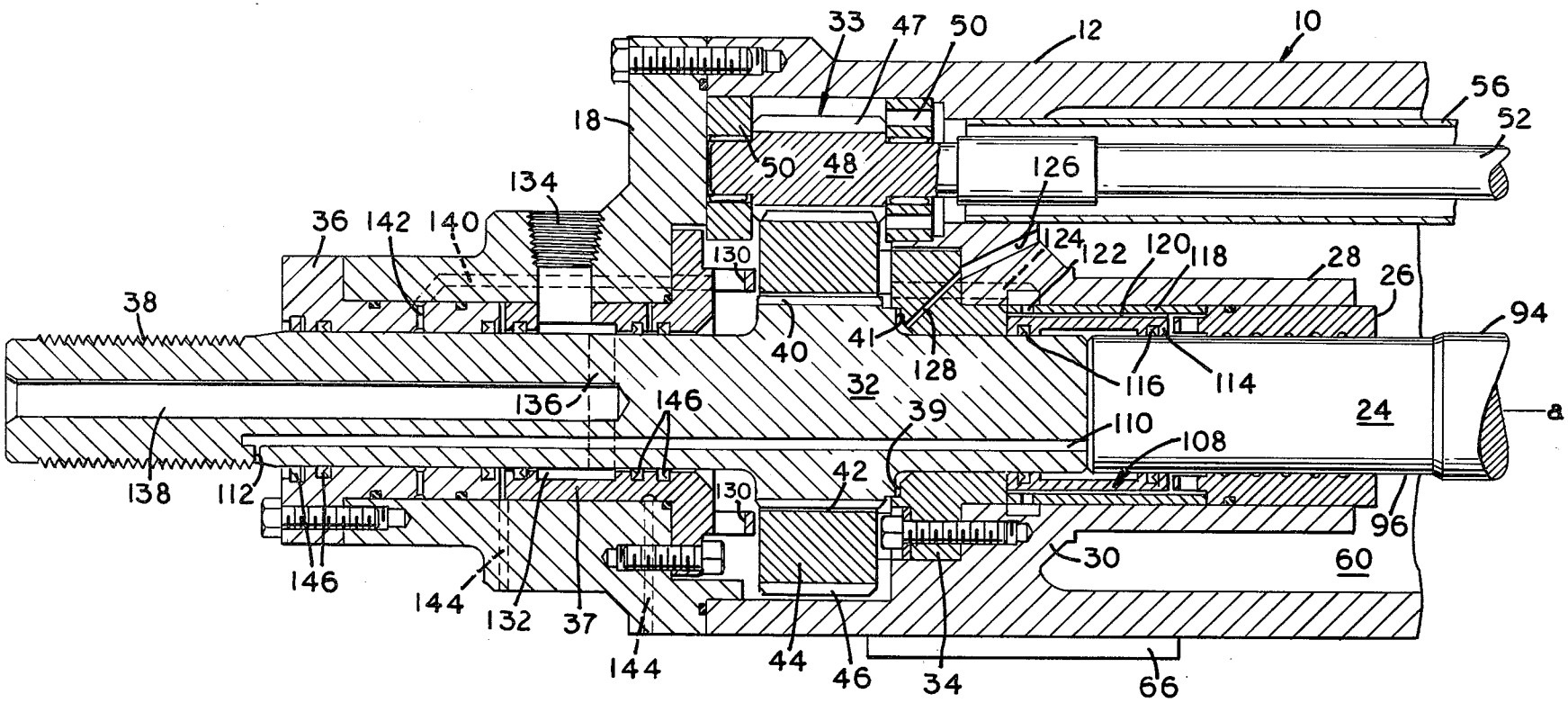
FIG. 1B is a fragmentary section view of the same, and showing an anvil end of the drill, it being understood that both views have a common center line "a"

A floating seal cartridge 108 is located at the region of impact between the piston 24 and anvil 32, which impact region communicates at all times with the atmosphere via a passageway 110 and a hole 112, both formed in the anvil, as best seen in FIG. 1B. The seal cartridge includes an inner floating member 114 having seal means 116 at each end for frictional engagement with the peripheral surfaces of the piston and anvil, and an outer cylindrical member 118 surrounding and in spaced relation to the floating member 114 to form a narrow cavity 120 therebetween. The friction of the seal means 116 transmits rotational action of the anvil 32 to the piston 24 to minimize rotative scrubbing which can occur at impact if rotative movement of the piston with the anvil is lacking. Frictional heat generated by the sealing action is dissipated by oil which comes from the reservoir 60 and leaks through the bushing 26 into the cavity 120. The cooling oil then flows to the interior of the gear housing 33 via radial holes 122 formed in the cylindrical member 118 and a passageway 124 formed in the bulkhead 30 and bushing 34.

Passageway means 126 formed in the bulkhead 30, and passageway means 128 formed in the bushing 34, provide oil flow from the reservoir 60 to the interior of the gear housing 33 for continual lubrication of the anvil drive gear assemblage during tool operation. High pressure oil flowing from passageway means 128 into the counterbore 39 serves as a snubber of rebound energy, in effect, providing a hydrostatic thrust bearing arrangement.

The flanged bushing 37 is provided with bumper means 130 arranged to limit forward axial movement of the ring gear 44 during reciprocal movement of the anvil 32. An undercut 132, formed on the inner peripheral surface of the flanged bushing 37, provides a cavity serving to connect an air inlet means 134 in the front head 18 with a plurality of radial holes 136 in the anvil member. The holes 136 are in communication with an axial passageway 138 formed in the anvil member and opening at the end of the threaded portion 38. In such manner, hole cleaning air under control of a valve means (not shown) can be introduced into the drill string. A passageway means 140, formed in the front head 18 and the flanged bushing 37, connects at one end with a plurality of radial holes 142, and with the interior of the gear housing 33 to provide lubrication of the forward end of the anvil member 32. Slight clearance between the flanged bushing 37 and the anvil member allows lubrication of the latter in the region thereof adjacent the forward end. Relief holes 144 are provided in front head 18 to serve as a warning of seal failure and to prevent air from entering the hydraulic system. A plurality of sealing rings 146 are disposed in the flanged bushings 36 and 37, as shown in FIG. 1B, to provide hole cleaning, air sealing and lubricant sealing of the anvil member 32 as required.

OPERATION OF PREFERRED EMBODIMENT

Figure 4:
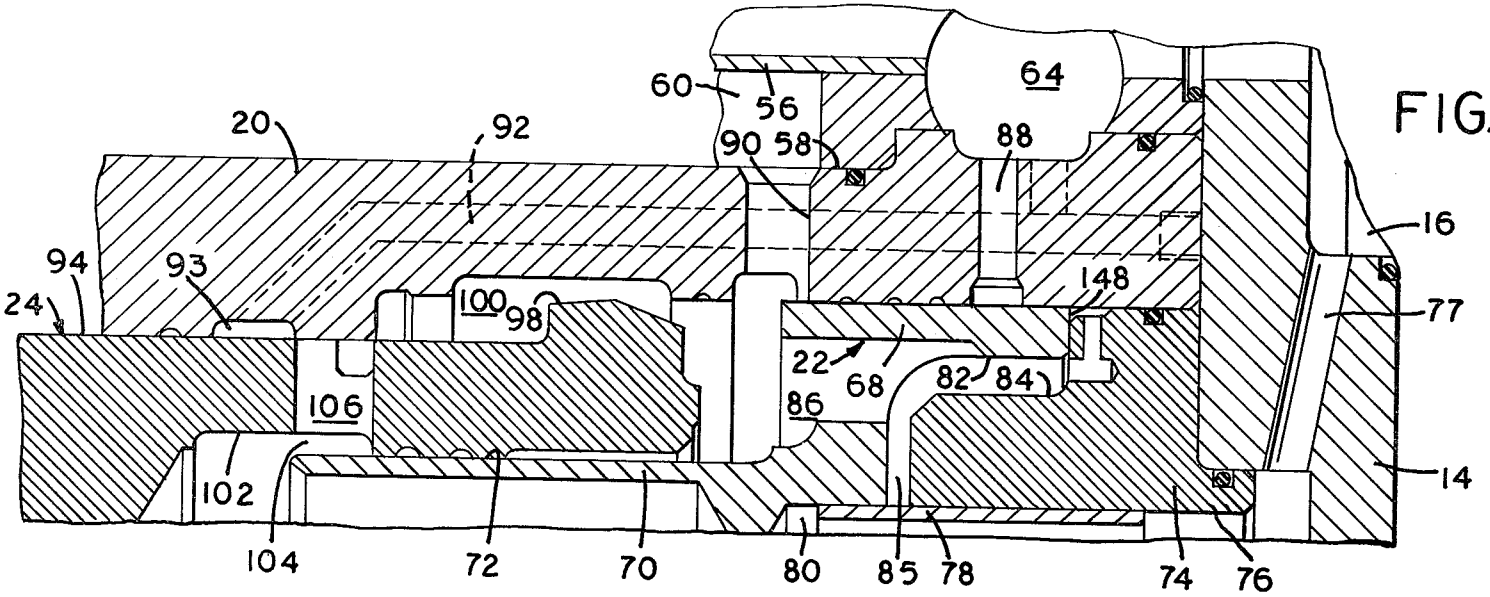
FIG. 4 is an enlarged sectional view illustrating the position of a cycle valve in one position of operation.
Figure 2:
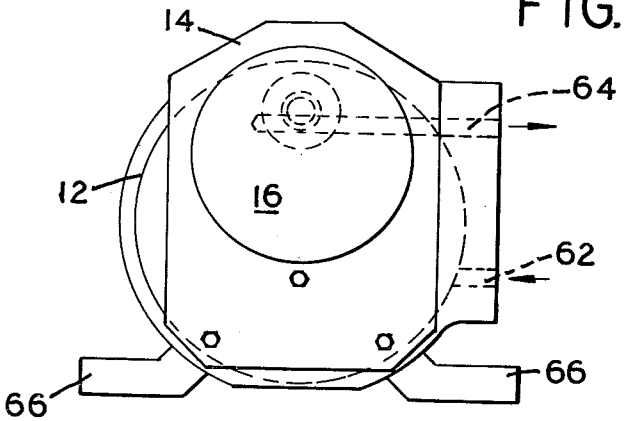
FIG. 2 is an end view, in reduced scale, of FIG. 1A.
Figure 3:
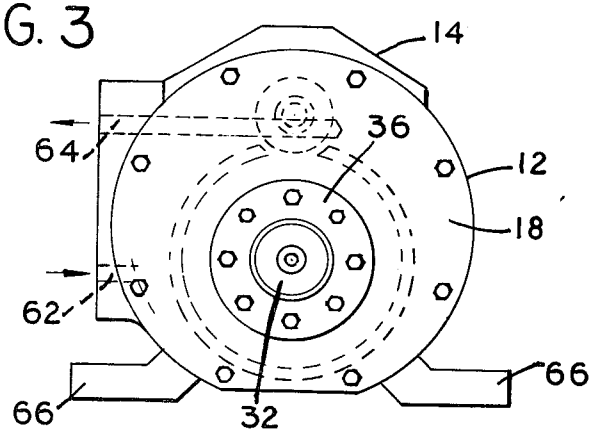
FIG. 3 is an end view, in reduced scale, of FIG. 1B.

Referring now to FIG. 4, the cycle valve 22 is illustrated as positioned at commencement of the power stroke which will result in an impact blow by the piston 24 upon the anvil 32. An end surface 148 of the valve body 68 is abutting the plug 74 cutting off flow of oil to the holes 88 leading to return flow passageway 64. In such position, the valve body 68 has opened communication of the reservoir 60 with the cavity 100 and the region at the end of the piston head 98 allowing pressurized oil to flow through the holes 86 into the cavity 85. High pressure oil acting upon the end of the piston head 98 causes the piston to begin movement toward the anvil 32. It will be seen that oil in the cavity 85 is blocked from flow into the bore 76 of the plug 74 by reason of the tubular stem 78 being slidingly engaged in the bore 80 of the valve body 68. As the piston holes 106 are moved to uncover circumferential groove 93, restricted passageway 92 cannot adequately supply rapidly expanding cavity 104, thereby creating a vacuum in cavity 104. A pressure differential acting upon the cycle valve 22 by reason of zero pressure oil in cavity 104 and high pressure oil in cavity 85, causes a rapid movement of the cycle valve toward the piston. Piston velocity becomes sufficient to cause impact of the piston with the anvil before the cycle valve can significantly cut off inward flow of oil from the reservoir through inlet holes 90. Acceleration of the cycle valve causes cut-off of inlet holes 90 in less than one milli-second after impact of the piston with the anvil. Power-stroke force is equal to reservoir pressure times the diametrical area of piston portion 96.

FIG. 1A illustrates the relative position of the cycle valve 22 and the piston 24 at impact and at beginning of return stroke of the piston. The force on the cycle valve is zero but it is moving rapidly toward the piston; however, before striking the piston, valve momentum will be substantially dissipated by the energy required to move the oil from the cavity 104 through restricted passageway 92. Return flow holes 88 and bore 76 are sized to control return speed of the piston by restricting oil flow out to the return passageway 64. A small pressure is thus created within the cylindrical member 20 which acts upon the valve stem 70 resulting in movement of the valve with the piston during early return stroke movement. During subsequent piston motion, cavity 104 is cut off from passageway 92 and the piston and cycle valve 22 are held together by friction alone.

The end of the piston will be seen to be in abutment with the valve body 68.

When a hydraulic cycle valve attains shift position, i.e., when outlet flow passages are about to be closed and inlet passages are about to be opened, or vice versa, there is significant leakage because valve overlap is very short. It is therefore desirable to traverse shift position at a reasonable speed, which should be faster than piston travel speed.

Figure 5:
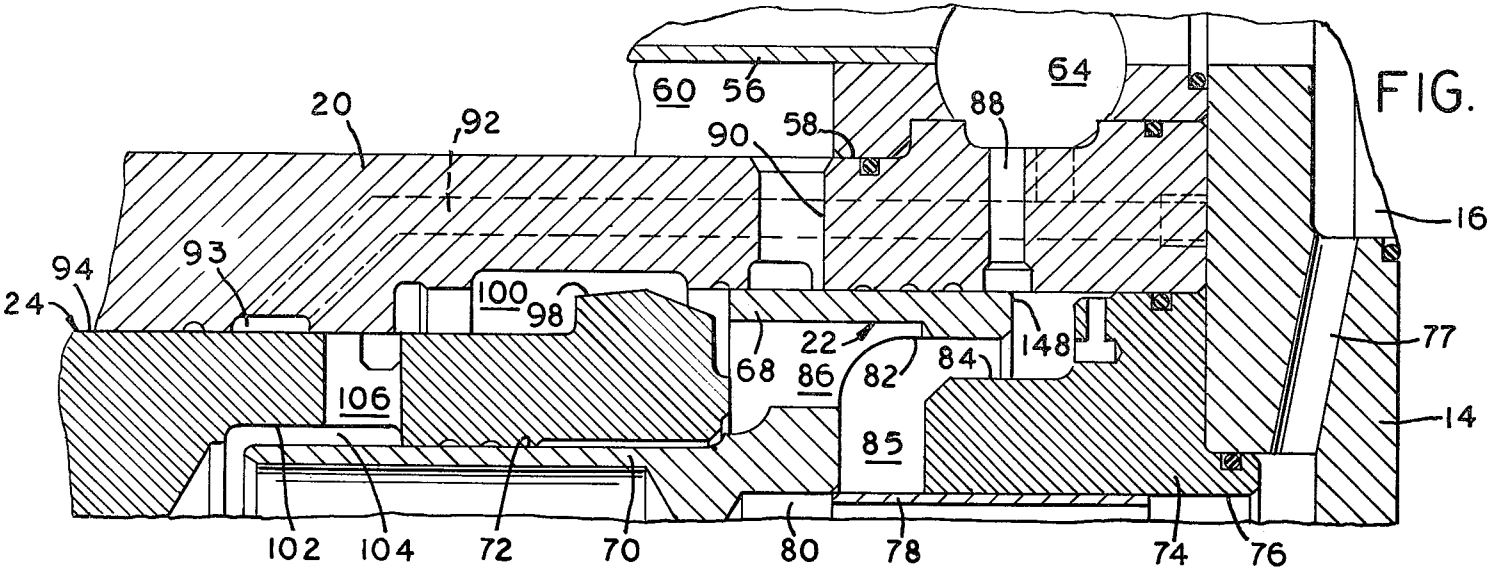
FIG. 5 is the same as FIG. 4 but showing the cycle valve in another position of operation.
Figure 6:
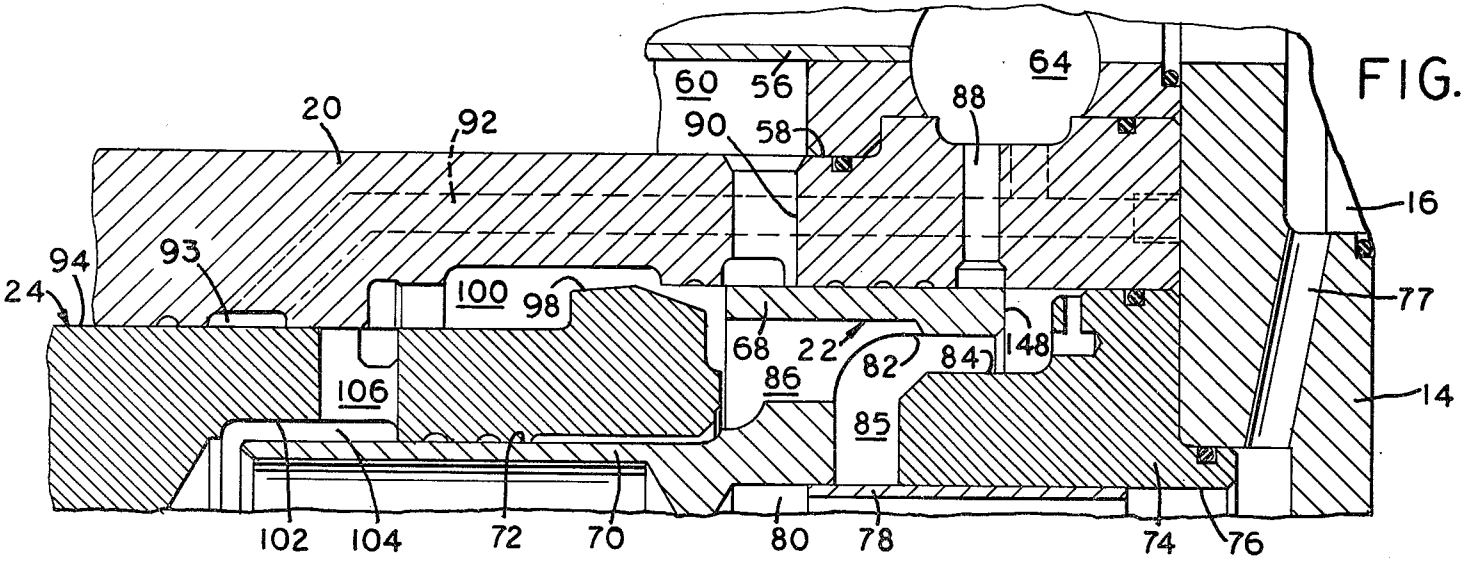
FIG. 6 is the same as FIG. 4 but showing the cycle valve in still another position of operation.

FIG. 5 illustrates operative condition which results in acceleration of the cycle valve 22. As seen therein, the tubular stem 78 has entered into the bore 80 cutting off return flow of oil entering passageway 77, resulting in increased oil pressure surrounding the entire valve, except for the area of the bore 80. The resulting force on the cycle valve 22 accelerates the valve so that at shift position the valve is separated slightly from the piston, as seen in FIG. 6. The nearly coincidental action of outlet closing and inlet opening, which supplies reservoir pressure within the cylindrical member 20, results in deceleration of the piston and beginning of the power stroke. Full pressure now acting upon the entire valve 22, except for low pressure existing in the bore 80, rapidly accelerates the valve toward the FIG. 4 position, and opens the inlet holes 88 to provide adequate inlet oil flow from the reservoir to accelerate the rapidly moving piston toward impact with the anvil. Rearward motion of the valve 22 is limited by engagement of the valve end surface 148 with the plug 74, as seen in FIG. 4. The valve 22 is thus shifted through a substantial portion of its cycle by means of hydraulic pressure applied thereto. For at least a portion of the valve's cycle, however, shifting is caused by abutment of the end of the piston with the valve body 68, as described above. This form of valve might be termed a mechanical hydraulic operated valve means.

If the anvil 32 should be beyond normal impact receiving position, as when the drill string is held away from hole bottom, energy of the piston is mostly absorbed by displacement of oil in cavity 100 through the decreasing clearance afforded by the tapered head 98 of the piston. Final clearance of the tapered head within the confines of the cavity 100 is such that the anvil, in full forward position, will receive low velocity blows from the piston. Relative axial dimensioning provides that the inner surface of the tapered piston head does not quite engage the forward end of the cavity 100. The low velocity, or light impact blows upon the anvil, are beneficially useable to loosen the threaded couplings of the drill string, as well as to shake loose a bit of the drill string that has become wedged in the hole being drilled.

We claim:

1. A rock drill including a housing arranged to form an hydraulic reservoir, a piston means slidingly supported for axial movement within the housing, said piston means having a major diameter portion and a minor diameter portion both of said portions being enclosed within the hydraulic reservoir and subject to the pressure of the fluid in the reservoir, a reciprocable anvil supported in the housing at a forward end thereof, a mechanical hydraulic operated valve means arranged in the housing to control reciprocal movement of the piston means for impact with the anvil, rotation means enclosed in a forward portion of the housing and adapted for selective rotation of the anvil in either rotary direction, a motor means affixed to a backhead plate secured to the housing, a shaft enclosed in the housing and operatively connecting the motor means with the rotation means, and a floating seal means surrounding a portion of both the anvil and the piston and having frictional engagement with the anvil and piston whereby rotational movement of the anvil rotates the piston.

2. A rock drill including a housing arranged to form an hydraulic reservoir, a piston means slidingly supported for axial movement within the housing, a reciprocable anvil supported in the housing at the forward end thereof, a mechanical-hydraulic operated valve means arranged in the housing to control reciprocal movement of the piston means for impact with the anvil, rotation means enclosed in a forward portion of the housing and adapted for selective rotation of the anvil in either rotary direction, a motor means affixed to a backhead plate secured to the housing, a shaft enclosed in the housing and operatively connecting the motor means with the rotation means, a floating seal means surrounding a portion of both the anvil and the piston and having frictional engagement with the anvil and piston whereby rotational movement of the anvil rotates the piston, and means to direct hydraulic fluid from the reservoir around the floating seal means and into the housing portion enclosing the rotation means whereby heat generated by the seal means because of frictional engagement with the anvil and piston is dissipated.

3. In a rock drill as in claim 3, wherein the valve means includes a valve stem slidingly arranged in an axial bore formed in the piston, and a valve body sequentially positionable for flow of hydraulic fluid from the reservoir to a cylindrical cavity formed in a piston supporting cylindrical member and from the cylindrical cavity to a return line leading to a sump serving a high pressure hydraulic pump connected to the hydraulic reservoir.

4. A rock drill including a housing arranged to form an hydraulic reservoir, a piston means slidingly supported for axial movement within the housing, said piston means having a major diameter portion and a minor diameter portion both of said portions being enclosed within the hydraulic reservoir and subject to the pressure of the fluid in the reservoir, a reciprocable anvil supported in the housing at a forward end thereof, a mechanical hydraulic operated valve means arranged in the housing to control reciprocal movement of the piston means for impact with the anvil, rotation means enclosed in a forward portion of the housing and adapted for selective rotation of the anvil in either rotary direction, a motor means affixed to a backhead plate secured to the housing, wherein the valve means includes a valve stem slidingly arranged in an axial bore formed in the piston, a valve body sequentially positionable for flow of hydraulic fluid from the reservoir to a cylindrical cavity formed in a piston supporting cylindrical member and from the cylindrical cavity to a return line leading to a sump serving a high pressure hydraulic pump connected to the hydraulic reservoir and wherein the axial bore in the piston connects with holes formed in the piston, said holes being exposed to the cylindrical cavity during one phase of piston operation, and are exposed to a passageway connecting to the return line during another phase of piston operation.

5. In a rock drill as in claim 4, wherein the piston engages the valve body for movement of the valve in one phase of piston operation.

6. In a rock drill as in claim 5, wherein a plug secured to the backhead plate has an axial bore connecting with a passageway for flow of hydraulic fluid to the return line, and a tubular stem arranged to project from the end of the plug bore and to be slidingly engaged within a bore formed in the valve body whereby flow of hydraulic fluid from the valve body to the return line is cut off.

7. In a rock drill as in claim 6, wherein the plug is in spaced circumferential relation to the valve body to form a cavity therebetween, said valve body having holes connecting said cavity with the cylindrical cavity enclosing the piston head.

8. A rock drill including a housing arranged to form an hydraulic reservoir, a piston means slidingly supported for axial movement within the housing, said piston means having a major diameter portion and a minor diameter portion both of said portions being enclosed within the hydraulic reservoir and subject to the pressure of the fluid in the reservoir, a reciprocable anvil supported in the housing at a forward end thereof, a mechanical hydraulic operated valve means arranged in the housing to control reciprocal movement of the piston means for impact with the anvil, rotation means enclosed in a forward portion of the housing and adapted for selective rotation of the anvil in either rotary direction, a motor means affixed to a backhead plate secured to the housing, wherein the shaft is surrounded by a tube shielding the shaft from pressure of hydraulic fluid in the reservoir, said tube being arranged to provide a conduit for fluid flow from the rotation means gear housing to a passageway means leading to a sump serving a high pressure hydraulic pump connected to the hydraulic reservoir.

9. An hydraulic rock drill including a housing arranged to form an hydraulic reservoir, a cylinder within the housing, a reciprocable hammer piston having a minor diameter portion located in the reservoir and a major diameter portion located in the reservoir and the cylinder, a cycle valve arranged within and coaxial with the cylinder, said cycle valve having a stem slidably arranged in the end of the piston and a tubular stem arranged in a backhead of the housing and connecting with an hydraulic fluid flow passageway leading to a sump serving a high pressure pump connected to the hydraulic reservoir, said cycle valve being shifted by the piston during a first phase of piston return stroke, and by hydraulic pressure in the cylinder acting upon the valve during a second phase of piston return stroke, said tubular stem serving as a control means in accordance with cycle valve position relative to the tubular stem.

* * * * *